US005292051A

United States Patent [19]

Nagahiro

[11] Patent Number: 5,292,051

[45] Date of Patent: Mar. 8, 1994

[54] CONNECTING METHOD AND STRUCTURE OF SUPERCONDUCTING WIRES

[75] Inventor: Toshinari Nagahiro, Hyogo, Japan

[73] Assignee: Mitsubishi Denki Kabushiki Kaisha, Tokyo, Japan

[21] Appl. No.: 18,272

[22] Filed: Feb. 16, 1993

[30] Foreign Application Priority Data

Feb. 26, 1992 [JP] Japan ..... 4-039403

[51] Int. Cl.[5] ..... H01R 4/68

[52] U.S. Cl. ..... 228/179.1; 228/189; 29/599

[58] Field of Search ..... 228/179, 189; 29/599

[56] References Cited

U.S. PATENT DOCUMENTS 4,631,808 12/1986 Jones ..... 29/599

4,894,906 1/1990 Huang ..... 29/599

FOREIGN PATENT DOCUMENTS 0077539 4/1983 European Pat. Off. .

OTHER PUBLICATIONS

Blair, Paik and Taber "How to make high critical current joint" from *Review Scientific Instruments* vol. 46, No. 8 pp. 1130–1131, Aug. 1975.

Witherell "Diffusion Welding Multifilament S.C." from *The Welding Journal* Jun. 1978.

*Primary Examiner*—Kenneth J. Ramsey

*Attorney, Agent, or Firm*—Sughrue, Mion, Zinn, Macpeak and Seas

[57] ABSTRACT

An exposed portion of superconducting filaments is disposed between a sleeve end and an end portion of a stabilizer in which the stabilizer is removed from superconducting wires. The sleeve pressed together with the superconducting filaments, the exposed portion and a peripheral portion of the stabilizer next to this exposed portion are integrated with each other by a wound tensile binding material such as a copper foil and a fixing material such as solder. In accordance with such a structure, it is possible to provide a connecting method of the superconducting wires in which no superconducting filaments in a wire connecting portion are disconnected and excessively distorted and a suitable rigidity of the connecting portion is obtained.

8 Claims, 6 Drawing Sheets

FIG. 10 (a) PRIOR ART
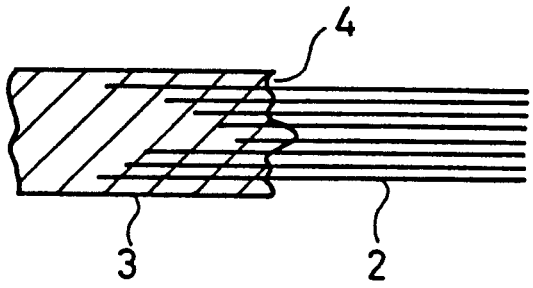
FIG. 10 (b) PRIOR ART
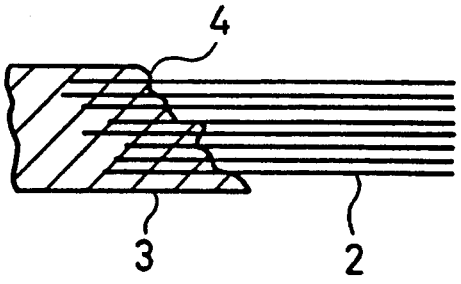

CONNECTING METHOD AND STRUCTURE OF SUPERCONDUCTING WIRES

BACKGROUND OF THE INVENTION

1. Field of the Invention

The present invention relates to connecting method and structure of superconducting wires used for a coil of a superconducting magnet, etc.

2. Description of the Prior Art

Each of the following methods is widely known as a general connecting method of superconducting wires.

(1) A method for overlapping and connecting superconducting wires to each other by soldering or welding.

(2) A method for removing stabilizers from superconducting wires to expose superconducting filaments and overlapping or twisting the superconducting filaments. Otherwise, A method for soldering, welding or melting-injecting an exposed portion of the superconducting filaments.

(3) A method for pressing superconducting filaments by using a sleeve instead of the soldering, welding or melting-injecting method in the above item (2).

The first method (1) is a simplest method. However, since superconducting filaments come in indirect contact with each other, the electric resistance of a connecting portion of the superconducting filaments is large so that this method is not suitable so much for a coil of a superconducting magnet, etc. requiring a persistent current mode.

In the second method (2), the superconducting filaments are directly connected to each other so that the electric resistance of a connecting portion of the superconducting filaments is greatly reduced. Therefore, this second method is used in many conventional examples. However, rigidity of the connecting portion is low so that it is necessary to further improve the second method to obtain a higher critical current value.

In the third method (3), the superconducting filaments are pressed by using the sleeve so that the superconducting filaments come in closer contact with each other and a higher critical current value can be obtained. Further, it is possible to expect higher rigidity of an entire connecting portion of the superconducting filaments. Therefore, this third method is generally used as a recent connecting method of superconducting wires.

FIG. 6 is a perspective view for explaining the construction of a superconducting wire. In FIG. 6, reference numerals 1 and 2 respectively designate a superconducting wire and a superconducting filament. For example, the superconducting filament is constructed by a wire material made of NbTi and having a diameter about 20 to 50 μm. A stabilizer 3 is used to electrically and thermally stabilize the superconducting filament 2 by burying the above superconducting filament 2 into the stabilizer 3. A copper material is often used as the stabilizer 3.

FIG. 7 is a cross-sectional view showing the above conventional connecting method (3) as a method for pressing the superconducting filaments by using the sleeve and shown in e.g., Japanese Laid-Open Patent No. 59-16207. In FIG. 7, reference numerals 1*a* and 1*b* respectively designate one superconducting wire and another superconducting wire to be connected. Reference numerals 2*a* and 2*b* respectively designate one superconducting filament and another superconducting filament for the superconducting wire 1*b*. Reference numerals 3*a* and 3*b* respectively designate stabilizers for the superconducting wires 1*a* and 1*b*. Reference numerals 4*a* and 4*b* respectively designate peeling faces of the superconducting wires 1*a* and 1*b* from which the above stabilizers 3*a* and 3*b* are removed by a corrosive solvent such as nitric acid. For example, a cylindrical sleeve 5 is made of copper and the above superconducting filaments 2*a* and 2*b* suitably bundled are inserted into this cylindrical sleeve 5. The above sleeve 5 is pressed in a direction of pressing force shown by an arrow 6. Reference numeral 7 designates a clearance of the superconducting filaments caused in the vicinity of the peeling faces 4*a* and 4*b* since no superconducting filaments 2*a* and 2*b* come in close contact with each other when the superconducting filaments 2*a* and 2*b* are pressed.

FIG. 8 is a cross-sectional view showing a conventional connecting method in which a shape of the sleeve 5 shown in FIG. 7 is partially changed.

In FIG. 8, constructional portions 1*a* to 4*a*, 1*b* to 4*b* and 5 to 7 are similar to those shown in FIG. 7. Therefore, an explanation about these constructional portions is omitted in the following description. A counter bore 5*a* is disposed in an inner diameter portion of the sleeve 5 at one end thereof and overlaps the stabilizers 3*a* and 3*b* at a length $l_1$. An arrow 6*a* designates a direction of pressing force applied to the sleeve 5 in a pressing range of the above length $l_1$.

FIG. 9 is a cross-sectional view showing another conventional connecting method shown in e.g., Japanese Laid-Open Patent No. 1-260776.

In FIG. 9, constructional portions 1*a* to 4*a*, 1*b* to 4*b* and 5 to 7 are similar to those shown in FIG. 7. Therefore, an explanation about these constructional portions is omitted in the following description. Taper portions 8*a* and 8*b* are formed and inclined at a predetermined angle with respect to peeling faces 4*a* and 4*b* from which stabilizers 3*a* and 3*b* are removed.

Procedures of the connecting methods will next be explained.

With respect to FIG. 7, the following procedures are carried out.

(1) The stabilizers 3*a* and 3*b* are respectively removed from the superconducting wires 1*a* and 1*b* to expose the superconducting filaments 2*a* and 2*b*.

(2) The exposed superconducting filaments 2*a* and 2*b* are suitably bundled.

(3) These superconducting filaments 2*a* and 2*b* are respectively inserted into the sleeve 5 until ends of the superconducting filaments 2*a* and 2*b* are in conformity with the peeling faces 4*a* and 4*b* of the above stabilizers 3*a* and 3*b*.

(4) Next, the sleeve 5 is pressed by using a tool such as an unillustrated die in the direction of the arrow 6 with a predetermined pressing force such as several ten tons.

In FIG. 8, the above procedures (1) to (4) with respect to FIG. 7 are similarly carried out. Namely, the superconducting filaments 2*a* and 2*b* are respectively pushed and inserted into the sleeve 5 until a deep position of the counter bore 5*a* such that positions of the peeling faces 4*a* and 4*b* of the stabilizers 3*a* and 3*b* are in conformity with this deep position.

(5) Thereafter, the sleeve 5 is pressed in the pressing range of the length $l_1$ by using a tool such as an unillustrated die in the direction of the arrow 6*a* with a predetermined pressing force. Thus, the sleeve 5 is fixed to the superconducting wires 1*a* and 1*b*.

In FIG. 9, the sleeve and the superconducting wires can be connected to each other in procedures approximately similar to the above procedures (1) to (5) with respect to FIG. 8. In this case, the pressed sleeve 5 is molded along the taper portions 8a and 8b on the peeling faces 4a and 4b from which the stabilizers 3a and 3b are removed.

FIGS. 10a and 10b are cross-sectional views showing a state of a peeling face 4 from which a stabilizer 3 is removed by a corrosive solvent such as nitric acid. FIG. 10a corresponds to FIGS. 7 and 8 and FIG. 10b corresponds to FIG. 9. In general, the peeling face 4 removing the stabilizer 3 therefrom is chemically processed as mentioned above. Accordingly, it is difficult to obtain a planar peeling face including a straight line as shown in each of FIGS. 7 to 9. Normally, an irregular peeling face 4 is obtained as shown in FIGS. 10a and 10b.

Accordingly, the conventional connecting method of the superconducting wires 1 each having such an irregular peeling face 4 has the following problems.

Firstly, when the superconducting filaments are pressed by using the sleeve 5, it is easy to cause a portion in which it is difficult to make the superconducting filaments close to each other by irregularities in the vicinity of the irregular peeling face 4. Therefore, many clearances 7 are formed and superconducting characteristics are reduced by these clearances 7.

Namely, the superconducting filaments 2 are slightly vibrated by influences of an applied magnetic field and a vibration thereof in a superconducting state so that the clearances 7 cause generation of heat of the superconducting filaments 2. As a result, a great disadvantage of transfer (called quench) from the superconducting state to a normal conducting state is caused.

Secondly, a portion of the superconducting filaments 2 in the vicinity of the peeling face 4 tends to be disconnected and excessively distorted by deformation of the sleeve 5 at a pressing time. Accordingly, a critical current in a connecting portion is reduced in comparison with a critical current (i.e., an electric current which can flow through the superconducting filaments in the superconducting state) in a range of the superconducting filaments covered with the stabilizer 3, thereby causing a change in superconducting characteristics. Further, no critical current is stabilized so that excessive dispersion in the critical current is caused.

Thirdly, when the superconducting filaments 2 are inserted into the sleeve 5 in a pressing operation, it is not easy to position the sleeve 5 by irregularities of the irregular peeling face 4. Accordingly, no base portions of the peeling face 4 and the sleeve 5 are firmly fixed after the pressing operation, thereby forming an unstable connecting portion. Therefore, it is impossible to provide a suitable rigidity for the connecting portion so that the superconducting filaments 2 tend to be disconnected and distorted. Further, similar to the above-mentioned case, the critical current is reduced and dispersion in the critical current is caused.

To solve these problems and obtain a preferable rigidity of the connecting portion, there is a proposed method in which the sleeve 5 overlaps the stabilizer 3 as shown in FIGS. 8 and 9 to form two separate pressing positions and press the sleeve in these two positions. However, no problems about disconnection and distortion of the superconducting filaments 2 in the vicinity of the peeling face 4 are sufficiently solved.

It is necessary to arrange a connection portion of a coil of a superconducting magnet, etc. in a position having a low magnetic flux density in consideration of the above reduction and dispersion in critical current. Such an arrangement limits design and manufacture of a connecting structure.

Further, when the coil is designed, an electric current density is reduced in consideration of the reduction and the dispersion in critical current so that cost of the coil as a product is increased.

SUMMARY OF THE INVENTION

To solve the above-mentioned problems, an object of the present invention is to provide a connecting structure of superconducting wires in which there is no clearance between superconducting filaments in a connecting portion and the superconducting filaments come in close contact with each other and there is no disconnection and excessive distortion of the superconducting filaments and a suitable rigidity of the connecting portion is obtained so that a critical current can be stably obtained.

The above object of the present invention can be achieved by a connecting method of superconducting wires in which a stabilizer is removed from each of the superconducting wires and superconducting filaments exposed by the removed stabilizer are inserted into a sleeve. An exposed portion of the superconducting filaments is disposed between an end portion of said stabilizer and an end of the sleeve. The sleeve and the superconducting filaments are pressed together. The exposed portion and a peripheral portion of the stabilizer next to this exposed portion are wound by a tensile winding material in a winding direction with a predetermined clearance. The exposed portion and the peripheral portion are integrated with each other by a fixing material.

The present invention also resides in a connecting structure of superconducting wires comprising superconducting filaments exposed from a stabilizer of each of the superconducting wires to be connected; a sleeve for inserting these superconducting filaments thereinto and pressed in a position separated by a predetermined length from an end portion of said stabilizer; a tensile binding material wound around an exposed portion of said superconducting filaments formed between an end of the sleeve and the end portion of said stabilizer and a peripheral portion near this exposed portion in a winding direction with a predetermined clearance; and a fixing material for integrating the exposed portion and the peripheral portion together with this tensile binding material.

The present invention also resides in a connecting structure of superconducting wires comprising superconducting filaments exposed from a stabilizer of each of the superconducting wires to be connected; a conductive film attached to these superconducting filaments; a tensile binding material wound around a connecting portion formed by bundling said superconducting filaments and a peripheral portion near this connecting portion in a winding direction with a predetermined clearance; and a fixing material for integrating the connecting portion and the peripheral portion together with said conductive film.

Namely, in the present invention, the tensile binding material and the fixing material are disposed in the exposed portion of the superconducting filaments formed between the end portion of the stabilizer and the sleeve end and the peripheral portion near this exposed portion. The tensile binding material and the fixing material improve rigidity of the connecting portion without disconnecting and excessively distorting the superconducting filaments by pressing the sleeve. Further, the tensile binding material and the fixing material reduce a clearance between the superconducting filaments tending to be caused in the vicinity of a peeling face of the stabilizer.

Further, the conductive film attached to the superconducting filaments in the present invention improves wettability of the fixing material and makes the superconducting filaments close to each other.

The above and other objects, features, and advantages of the invention will become more apparent from the following description when taken in conjunction with the accompanying drawings.

BRIEF DESCRIPTION OF THE DRAWINGS

FIGS. 10*a* and 10*b* are cross-sectional views showing a state of a peeling face removing a stabilizer therefrom.

DESCRIPTION OF THE PREFERRED EMBODIMENTS

The preferred embodiments of connecting method and structure of superconducting wires in the present invention will next be described in detail with reference to the accompanying drawings.

Figure 1:
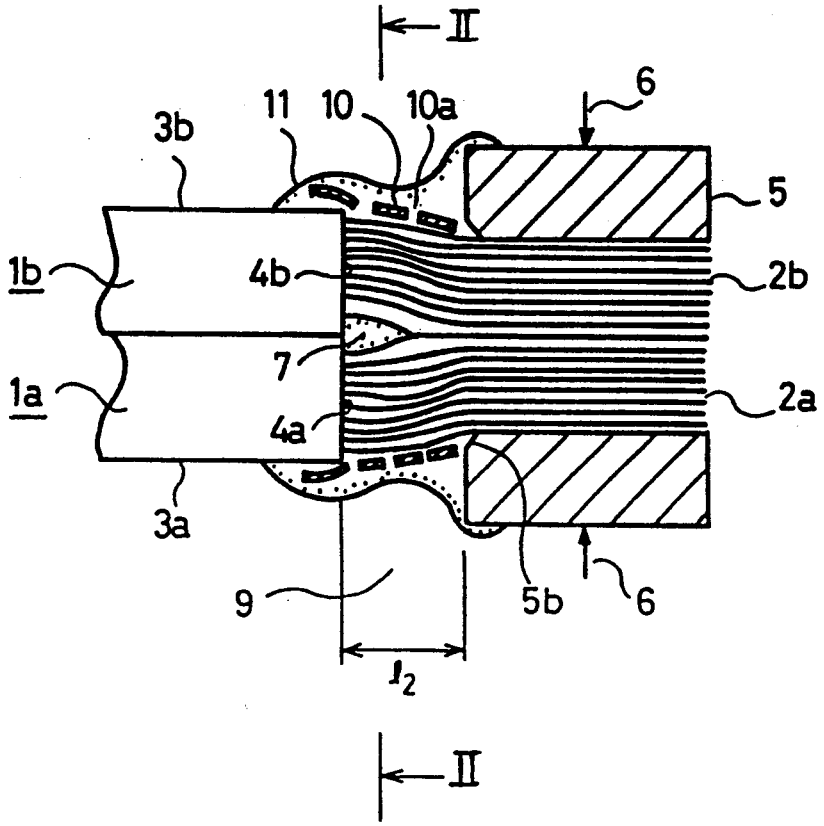
FIG. 1 is a cross-sectional view showing a first embodiment of the present invention.

FIG. 1 is a cross-sectional view showing a first embodiment of the present invention. In FIG. 1, constructional portions 1*a* to 4*a*, 1*b* to 4*b*, and 5 to 7 are similar to those in a conventional connecting structure. Therefore, a description about these constructional portions is omitted in the following description. A chamfering portion 5*b* is disposed in an inner circumferential portion of a sleeve 5 at one end thereof. An exposed portion 9 of superconducting filaments 2*a*, 2*b* is disposed between the one end of the sleeve 5 and peeling faces 4*a*, 4*b* from which stabilizers 3*a*, 3*b* are respectively removed. This exposed portion 9 has a predetermined length $l_2$ as shown in FIG. 1. A tensile binding material 10 is wound around the above exposed portion 9 and a peripheral portion near this exposed portion 9 in close contact with the stabilizers 3*a*, 3*b* and the superconducting filaments 2*a*, 2*b*. For example, the tensile binding material 10 is constructed by a copper foil. A fixing material 11 is disposed in the above exposed portion 9 and the peripheral portion near this exposed portion 9. For example, this fixing material 11 is constructed by solder. A clearance 10*a* is formed in advance in a winding direction of the above tensile binding material 10 when this tensile binding material 10 is wounded.

Figure 2:
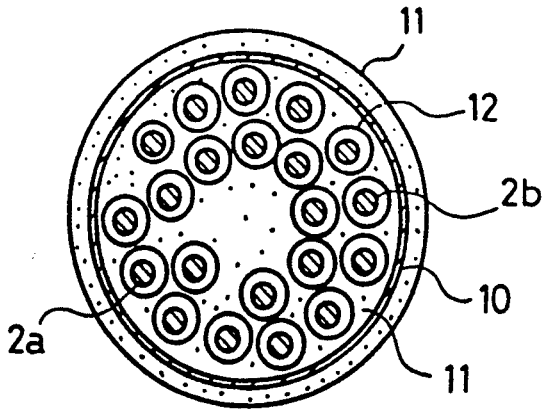
FIG. 2 is a cross-sectional view taken along line II—II of each of FIGS. 1 and 4 in the present invention.

FIG. 2 is a cross-sectional view taken along line II—II of FIG. 1. In FIG. 2, constructional portions 2*a*, 2*b*, 10 and 11 are already explained in relation to FIG. 1. Therefore, an explanation about these constructional portions is omitted in the following description. A conductive film 12 is attached to the superconducting filaments 2*a* and 2*b*. For example, this conductive film 12 is constructed by a copper film formed by copper plating.

Procedures of the connecting method in the connecting portion constructed above will next be explained.

(1) The stabilizers 3*a* and 3*b* are respectively removed from the superconducting wires 1*a* and 1*b* by a corrosive solution such as nitric acid to expose the superconducting filaments 2*a* and 2*b*.

(2) The exposed superconducting filaments 2*a* and 2*b* are suitably bundled or twisted.

(3) The bundled superconducting filaments 2*a* and 2*b* are inserted into the sleeve 5 from a side of the chamfering portion 5*b* thereof.

(4) A predetermined length $l_2$ between one end of the sleeve 5 and the peeling faces 4*a*, 4*b* of the stabilizers 3*a*, 3*b* is secured to form an exposed portion 9 of the superconducting filaments 2*a*, 2*b*.

(5) The sleeve 5 is pressed by using a tool such as an unillustrated die with a predetermined pressing force in the direction of an arrow 6.

(6) The exposed portion 9 of the superconducting filaments 2*a*, 2*b* between the one end of the sleeve 5 and the peeling faces 4*a*, 4*b* removing the stabilizers 3*a*, 3*b* therefrom and a peripheral portion near this exposed portion are plated with copper so that a conductive film 12 is attached to these portions.

(7) A tensile binding material 10 such as a copper foil is wound around the above exposed portion 9 and the above peripheral portion in a winding direction with a predetermined clearance 10*a*.

(8) The above exposed portion 9 and the above peripheral portion are integrated with each other by a fixing material 11, e.g., soldering. At this time, the fixing material 11 as solder is flowed from the clearance 10*a* and fixes the superconducting filaments 2*a* and 2*b* to each other.

The connecting method in the first embodiment has the following effects in accordance with the above-mentioned processing.

Namely, the sleeve 5 is pressed in a position separated from the peeling faces 4 of the stabilizers 3 so that no excessive pressing force for pressing the sleeve 5 is directly applied to the superconducting filaments 2 near the peeling faces 4. Accordingly, no superconducting filaments 2 near the peeling faces 4 are disconnected and excessively distorted so that it is possible to obtain a connection portion of the superconducting wires in which no critical current is reduced and dispersion in critical current is reduced.

Further, the tensile binding material 10 is wound around the exposed portion 9 of the superconducting filaments 2 and the peripheral portion near this exposed portion. Constructional portions near the tensile binding material 10 are integrated with each other by the solder 11. Accordingly, no clearance 7 between the superconducting filaments 2 is caused so that it is possible to obtain a wire connecting portion having a suitable rigidity.

Further, the conductive film 12 formed by copper plating is attached to the superconducting filaments 2 near the peeling faces 4 so that wettability of the solder 11 is improved. Accordingly, the solder 11 is easily flowed until an internal portion of the exposed portion 9 of the superconducting filaments 2 through the clearance 10*a* of the tensile binding material 10. Therefore, the superconducting filaments 2 come in closer contact with each other and it is possible to prevent the clearance 7 from being caused.

Further, since the copper foil constituting the tensile binding material 10 is wounded, heat can be transmitted to the stabilizers 3 through the tensile binding material 10 when the superconducting filaments 2 are heated. Accordingly, it is possible to prevent the superconducting filaments from being damaged when a superconducting state is transferred (or quenched) to a normal conducting state.

Further, since no critical current is reduced and dispersion in critical current is reduced, connecting portions of a coil can be connected to each other in an arbitrary position so that degrees of freedom with respect to design and manufacture are increased.

Furthermore, if a disconnection trouble of superconducting wires is accidentally caused in an arbitrary position at a manufacturing time, the superconducting wires can be connected to each other in this position in which the disconnection trouble is caused, thereby rapidly performing a restoring operation.

Figure 3:
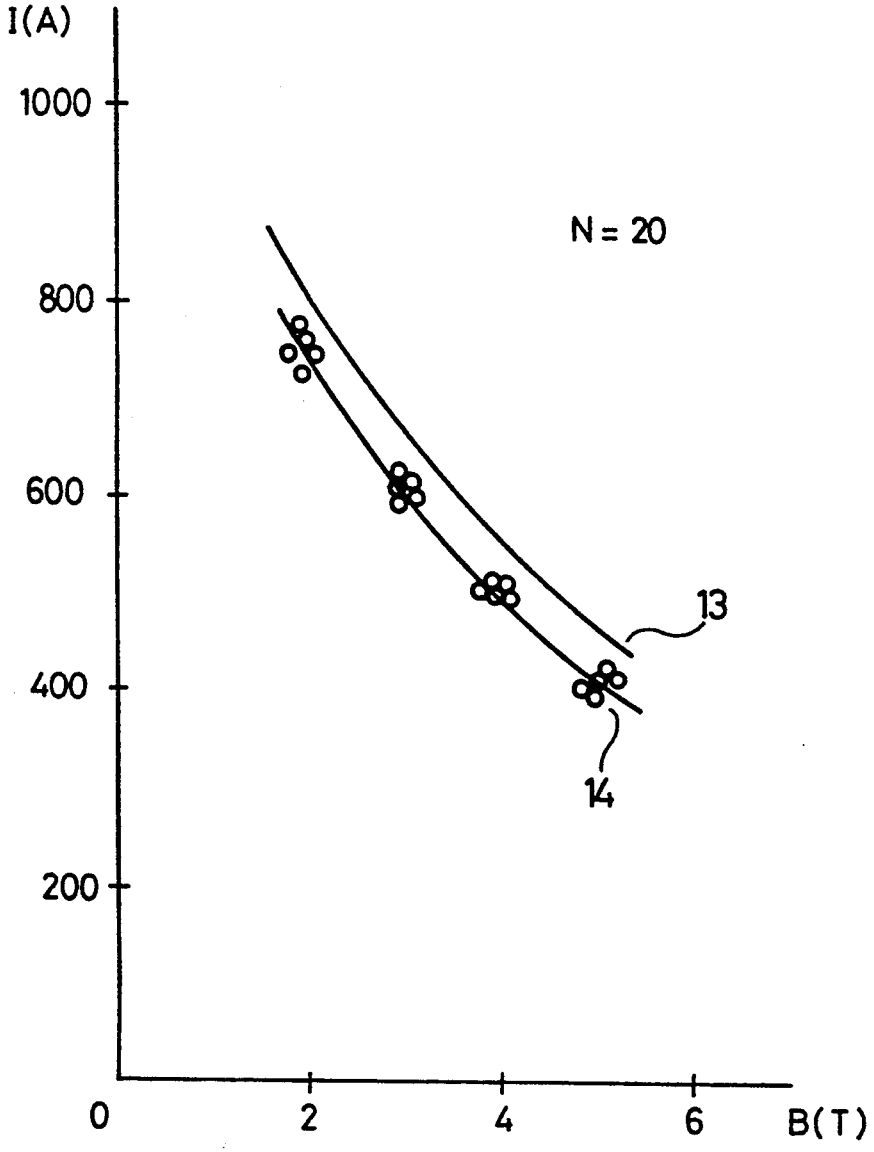
FIG. 3 is a characteristic graph showing measured data of electric characteristics in a wire connection portion in the first embodiment of the present invention.

FIG. 3 shows measured data of electric characteristics in the connecting portion in the first embodiment of the present invention. In FIG. 3, axis of abscissa shows a magnetic flux density (T means tesla) of a magnetic field and axis of ordinate shows a critical current (A means ampere). A curve 13 shows a critical current of an element wire in a covering range of the stabilizers 3. The critical current is measured at twenty measuring points 14 by using samples of the connecting portion in this embodiment with the magnetic flux density as a reference.

As clearly seen from FIG. 3, the curve 13 is very close to the measuring points 14 of the connecting portion in this embodiment. Further, the dispersion in critical current of the same magnetic flux density is very reduced and stable electric characteristics can be obtained.

Figure 4:
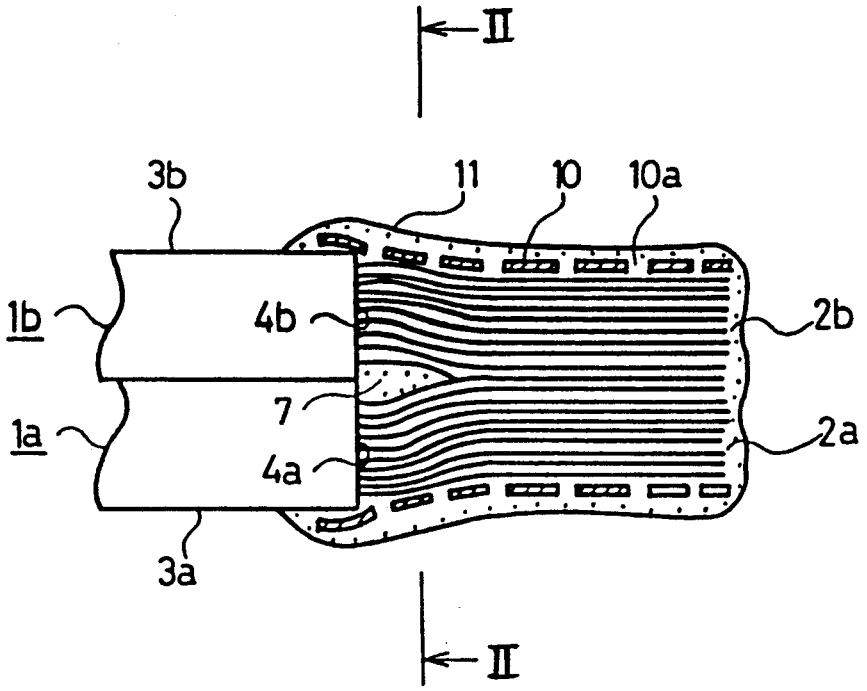
FIG. 4 is a cross-sectional view showing a second embodiment of the present invention.

FIG. 4 is a cross-sectional view showing a second embodiment of the present invention. In FIG. 4, constructional portions 1*a* to 4*a*, 1*b* to 4*b*, 7, 10, 10*a* and 11 are already explained in the above first embodiment. Therefore, an explanation about these constructional portions is omitted in the following description. Sectional line II—II of FIG. 4 is similar to that of FIG. 2 mentioned above.

In this second embodiment, no sleeve 5 in the first embodiment is used. Superconducting wires are connected to each other by only a tensile binding material 10 and a fixing member 11 and there is no pressing process. Procedures of the connecting method in this second embodiment will next be explained.

(1) Stabilizers 3*a*, 3*b* are respectively removed from superconducting wires 1*a*, 1*b* by a corrosive solvent such as nitric acid to expose superconducting filaments 2*a*, 2*b*.

(2) The exposed superconducting filaments 2*a* and 2*b* are suitably bundled or twisted.

(3) A connecting range portion of the superconducting filaments 2*a* and 2*b* suitably bundled or twisted in the above item (2) and a peripheral portion near this connecting range portion are plated with copper so that a conductive film 12 is attached to these portions.

(4) A tensile binding material 10 is wound around the above connecting range portion and the above peripheral portion with a clearance 10*a*.

(5) The above connecting range portion and the above peripheral portion are integrated with each other by a fixing material 11, e.g., soldering.

As mentioned above, a connecting portion having a suitable rigidity similar to that in the first embodiment is obtained by forming the conductive film 12 by copper plating, etc. even when no sleeve 5 is used. Further, no superconducting filaments 2 near peeling faces 4 are disconnected and excessively distorted so that it is possible to obtain a connecting portion of the superconducting wires in which no critical current is reduced and dispersion in critical current is reduced.

Figure 5:
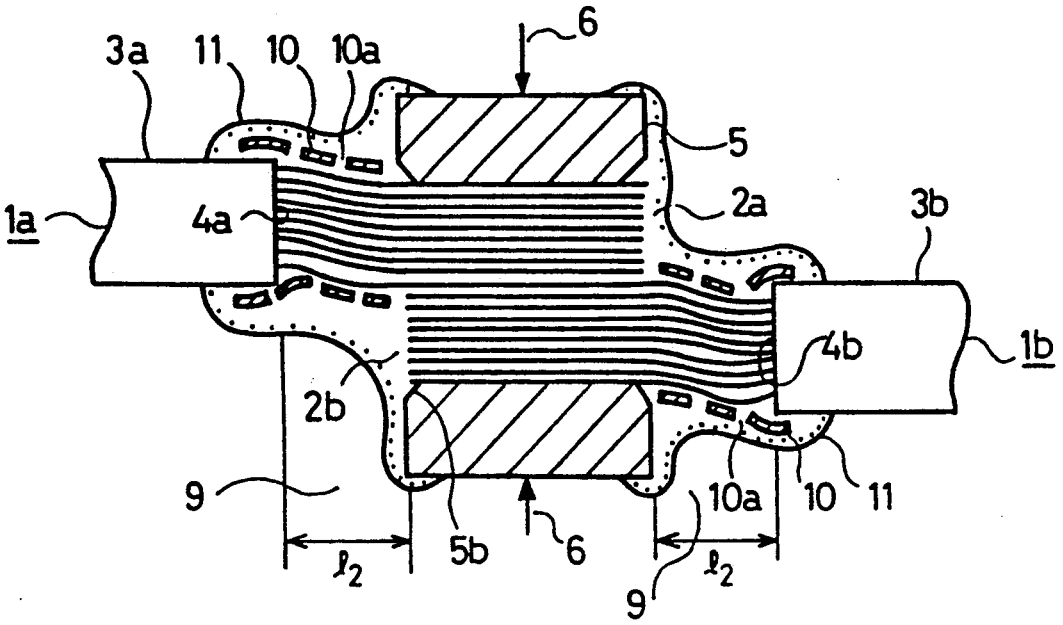
FIG. 5 is a cross-sectional view showing a third embodiment of the present invention.
Figure 6:
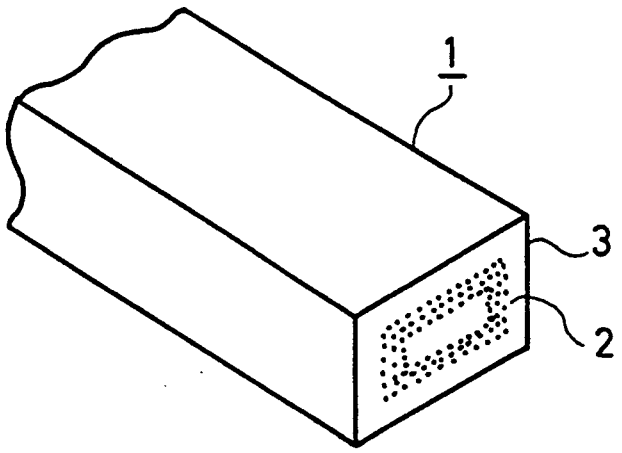
FIG. 6 PRIOR ART
FIG. 6 is a perspective view for explaining the construction of a superconducting wire.
Figure 7:
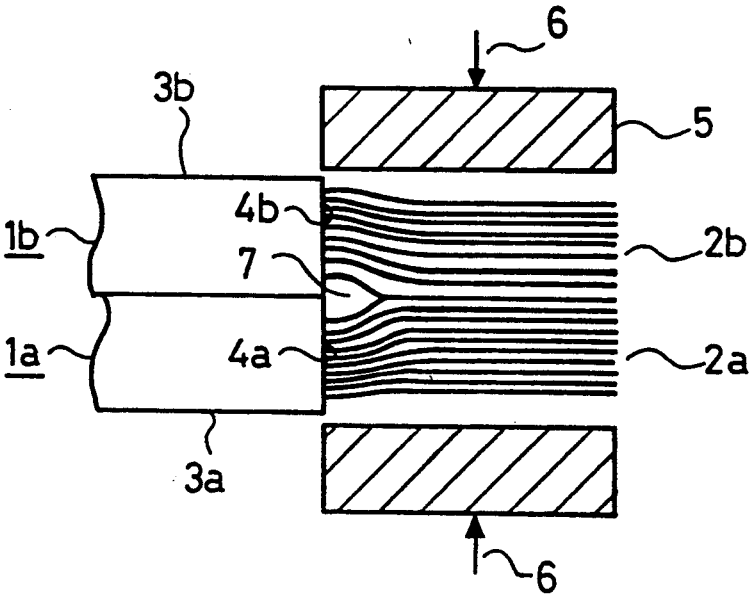
FIG. 7 PRIOR ART
FIG. 7 is a cross-sectional view showing one example of conventional connecting methods.
Figure 8:
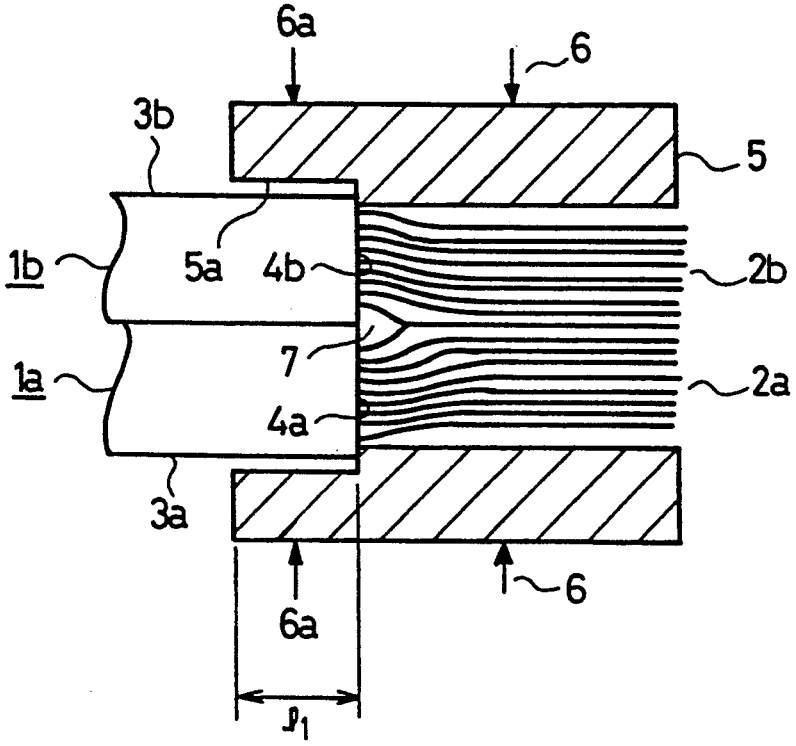
FIG. 8 PRIOR ART
FIG. 8 is a cross-sectional view showing another example of the conventional connecting methods.
Figure 9:
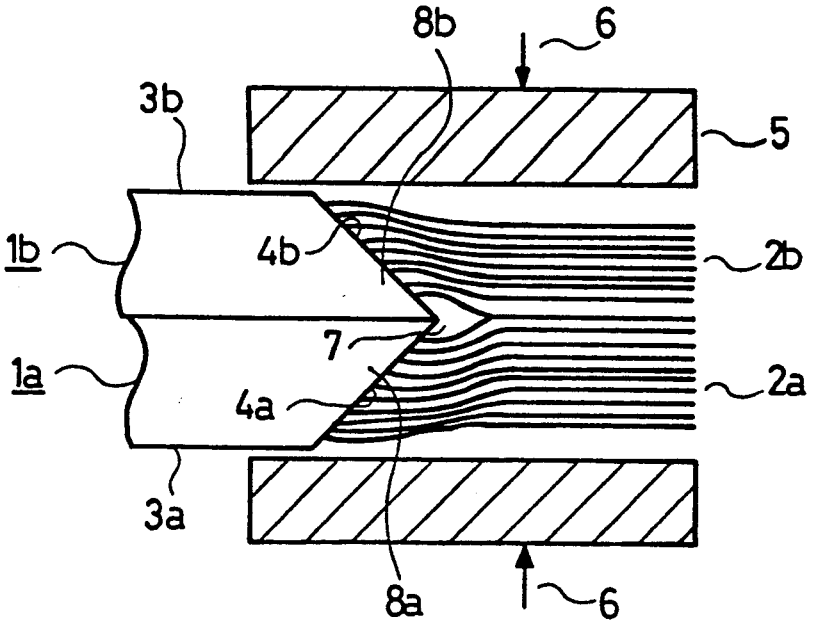
FIG. 9 PRIOR ART
FIG. 9 is a cross-sectional view showing another example of the conventional connecting methods.

In the above embodiments, the superconducting wires 1*a* and 1*b* are connected to each other such that these superconducting wires are overlapped in parallel with each other. However, as illustrated in FIG. 5 showing a third embodiment of the present invention, the present invention can be also applied to a method for connecting the superconducting wires 1*a* and 1*b* in series with each other. In this case, a predetermined length $l_2$ between both ends of a sleeve 5 and peeling faces 4*a*, 4*b* is secured to dispose exposed portions 9 of superconducting filaments 2*a*, 2*b*.

In the above embodiments, two superconducting wires are connected to each other. However, the present invention can be similarly applied to a connecting structure in which three or more superconducting wires are connected to each other.

Further, in the above embodiments, a copper foil is used as the tensile binding material 10 and solder is used as the fixing material 11. However, a metallic wire such as a copper wire may be used instead of the copper foil and a conductive adhesive may be used instead of the solder.

Further, if another conductive reinforcing member is added to the entire connecting portion and this reinforcing member and the connecting portion are tensioned and bound by a binding wire, etc. and are soldered, it is possible to obtain a connecting portion having a higher rigidity.

As mentioned above, in accordance with the present invention, stabilizers are removed from respective superconducting wires and an exposed portion of superconducting filaments is disposed between an end portion of the stabilizers and a sleeve end. The superconducting filaments and the sleeve are pressed and a tensile binding material is wound around the exposed portion and a peripheral portion near this exposed portion. Thus, the exposed portion and the peripheral portion are integrated with each other by a fixing material. Accordingly, it is possible to obtain a wire connecting portion having a suitable rigidity. Further, it is possible to prevent a critical current from being reduced and prevent dispersion in critical current. Accordingly, it is possible to provide a coil of a superconducting magnet, etc. having a stable quality and cheaply manufactured.

Further, similar to the above case, a connecting portion having stable superconducting characteristics can be obtained as long as no sleeve is used but superconducting filaments are close to each other by suitably bundling or twisting these filaments even when a conductive film is then attached to the superconducting filaments.

What is claimed is:

1. A connecting method of superconducting wires in which a stabilizer is removed from a connecting portion of each of the superconducting wires to be connected and each of superconducting filaments exposed by this stabilizer is bundled and inserted into a sleeve and is pressed;

said connecting method comprising the steps of:

disposing an exposed portion of the superconducting filaments between an end portion of said stabilizer and said sleeve;

winding said exposed portion and a peripheral portion of said stabilizer next to said exposed portion by a tensile winding material in a winding direction with a predetermined clearance; and integrating at least a portion of said sleeve, the exposed portion, the peripheral portion and said winding material with each other by a fixing material.

2. A connecting structure of superconducting wires comprising:

superconducting filaments exposed from a stabilizer of each of the superconducting wires to be connected;

a sleeve for inserting these superconducting filaments thereinto and pressed in a position separated by a predetermined length from an end portion of said stabilizer;

a tensile binding material wound around an exposed portion of said superconducting filaments formed between an end of the sleeve and the end portion of said stabilizer and a peripheral portion of said stabilizer next to said exposed portion in a winding direction with a predetermined clearance; and a fixing material for integrating at least a portion of said sleeve, the exposed portion and the peripheral portion together with this tensile binding material.

3. A connecting structure of superconducting wires comprising:

superconducting filaments exposed from a stabilizer of each of the superconducting wires to be connected;

a conductive film attached to these superconducting filaments;

a tensile binding material wound around a connecting portion formed by bundling said superconducting filaments and a peripheral portion of said stabilizer next to said connecting portion in a winding direction with a predetermined clearance; and a fixing material for integrating said tensile binding material, the connecting portion and the peripheral portion together with said conductive film.

4. A connecting method of superconducting wires as claimed in claim 1, wherein a copper foil or a metallic wire is used as the tensile binding material.

5. A connecting method of superconducting wires as claimed in claim 1, wherein solder or a conductive adhesive, is used as the fixing material.

6. A connecting method of superconducting wires as claimed in claim 1, wherein the sleeve is pressed in a position separated from a peeling face of the stabilizer.

7. A connecting method of superconducting wires as claimed in claim 1, wherein the superconducting wires are overlapped in parallel with each other.

8. A connecting method of superconducting wires as claimed in claim 1, wherein the superconducting wires are connected in series with each other.

* * * * *